United States Patent [19]

Fioravanti et al.

[11] Patent Number: 4,869,749

[45] Date of Patent: Sep. 26, 1989

[54] CHEMICAL DEHYDROGENATION OF MOLTEN FERROUS ALLOYS USING A HALOGEN-CONTAINING COMPOUND

[75] Inventors: Kenneth J. Fioravanti, Allentown; David W. Kern, Slatedale; Philip D. Stelts, Center Valley, all of Pa.

[73] Assignee: Air Products and Chemicals, Inc., Allentown, Pa.

[21] Appl. No.: 276,094

[22] Filed: Nov. 23, 1988

[51] Int. Cl.[4] ..... C21C 7/02

[52] U.S. Cl. ..... 75/58; 75/53

[58] Field of Search ..... 75/58, 53

[56] References Cited

U.S. PATENT DOCUMENTS 3,060,015 10/1962 Spolders et al. ..... 75/60

3,199,976 8/1965 Dammer et al. ..... 75/59

4,451,288 5/1984 Andreini et al. ..... 75/60

FOREIGN PATENT DOCUMENTS 27938 2/1983 Japan .

*Primary Examiner*—Peter D. Rosenberg

*Attorney, Agent, or Firm*—Willard Jones, II; James C. Simmons; William F. Marsh

[57] ABSTRACT

The present invention is a process for the removal of hydrogen from molten ferrous alloys in the unkilled state via a chemical reaction with a halogen-containing compound. The halogen-containing compound is typically introduced into the molten alloy in the gaseous state. The process can be carried out in a conventional ladle metallurgy station.

8 Claims, 5 Drawing Sheets

FIG. 2
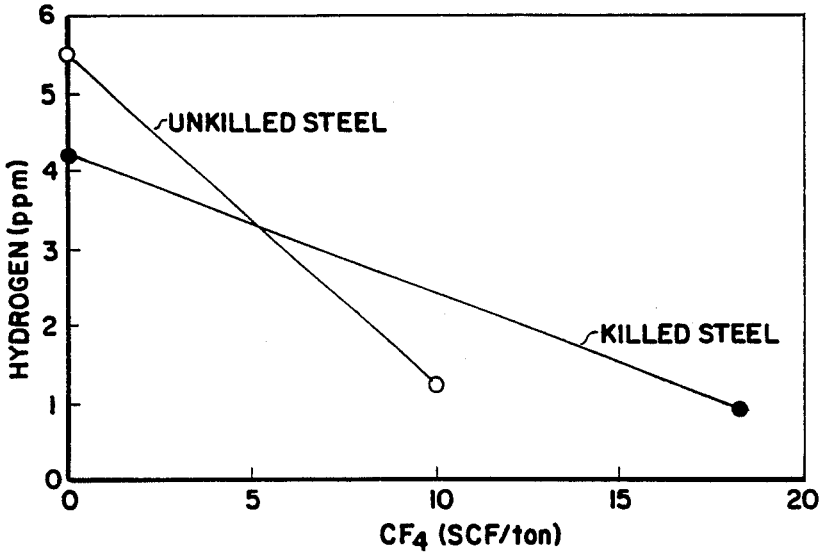
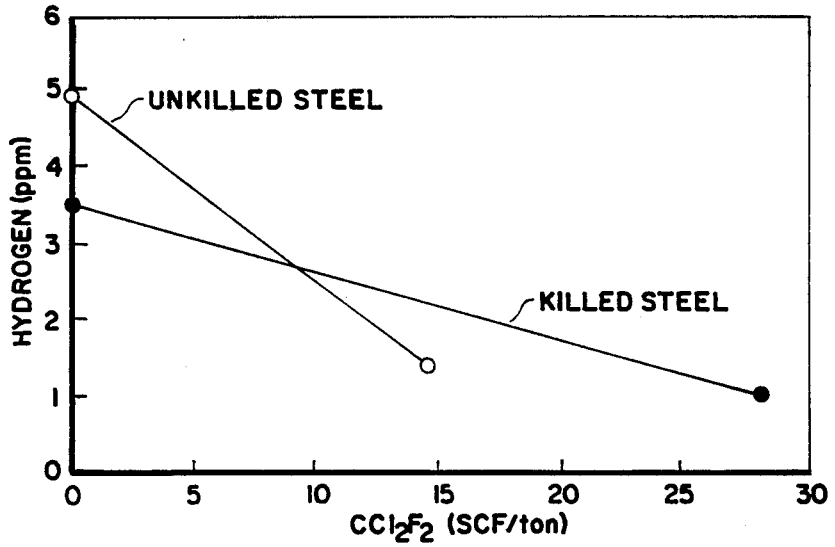
FIG. 3

CHEMICAL DEHYDROGENATION OF MOLTEN FERROUS ALLOYS USING A HALOGEN-CONTAINING COMPOUND

TECHNICAL FIELD

The present invention relates to a process for the removal of hydrogen from molten ferrous alloys by reaction with a halogen-containing compound.

BACKGROUND OF THE INVENTION

Concentrations of dissolved hydrogen in steel, as low as 2 ppm, are known to be detrimental in many critical applications. Typical concentrations of hydrogen in molten steel are on the order of 3–17 ppm. Large forgings and thick rolled plate products are particularly susceptible to hydrogen embrittlement which may lead to flaking and cracking. Several industry and government material specifications require median dissolved hydrogen contents to be below 2 PPM for certain applications and grades of steel.

There are several processes known for the removal of hydrogen in the art; among these are the following:

Vacuum treating of steel is the only commercially acceptable method of reducing dissolved hydrogen (H) to very low levels in the molten state. This method exposes the molten metal to a vacuum having a pressure on the order of 0.5 torr. This is a mechanical means of inducing $H_2$ out-gassing. Hydrogen levels below 2 PPM can be obtained if the process is performed correctly. This type of hydrogen removal is taught in U.S. Pat. No. 3,060,015.

Another method of degassification is the slow cooling of steel products, such as blooms and slabs, to allow the hydrogen to diffuse out of the steel naturally. Such slow cooling, however, extends processing time, ties up inventory and require extreme care to ensure reliable results.

There are also processes using large amounts of gas sparging to help reduce the dissolved hydrogen content. Generally, there are referred to as subsurface pneumatic refining processes, e.g., argon/oxygen decarburization (AOD). Unfortunately, these processes are not a reliable or effective method of producing low H metal. Disclosure of these subsurface pneumatic refining processes and their modification to produce a low H metal is provided in U.S. Pat. No. 4,451,288.

Reaction of halogen-containing compounds with molten steel in the "killed" state to chemically remove dissolved hydrogen has also been investigated. This type of chemical removal process is taught in U.S. Pat. No. 3,199,976 and Japanese Patent Application 1981-125,276. Unfortunately, the reaction rates and process efficiencies for this process are low which renders them commercially unacceptable.

SUMMARY OF THE INVENTION

The present invention is an improvement to a process for the removal of dissolved hydrogen from molten ferrous metals by chemical reaction. In the process, a halogen-containing compound is admixed with the molten ferrous metal whereby the halogen in the halogen-containing compound reacts with the dissolved hydrogen to form a gaseous hydrogen halide, which is removed as a gas from the molten ferrous metal. The improvement to the process for increasing process efficiency comprises injecting the halogen-containing compound into the molten ferrous metal which is in the non-deoxidized or unkilled state.

The preferred halogen-containing compounds are halogen-containing gases such as tetrafluoromethane, dichlorodifluoromethane and sulfur hexafluoride.

Following the removal of hydrogen the molten ferrous metal can be deoxidized and alloyed.

BRIEF DESCRIPTION OF THE DRAWINGS

FIG. 2 is a plot showing dissolved hydrogen levels versus $CF_4$ injection for the removal of hydrogen from various steel melts. The slope of the line is proportional to the reaction rate.

FIG. 3 is a plot showing dissolved hydrogen levels versus $CCl_2F_2$injection for the removal of hydrogen from various steel melts. The slope of the line is proportional to the reaction rate.

DETAILED DESCRIPTION OF THE INVENTION

Figure 1:
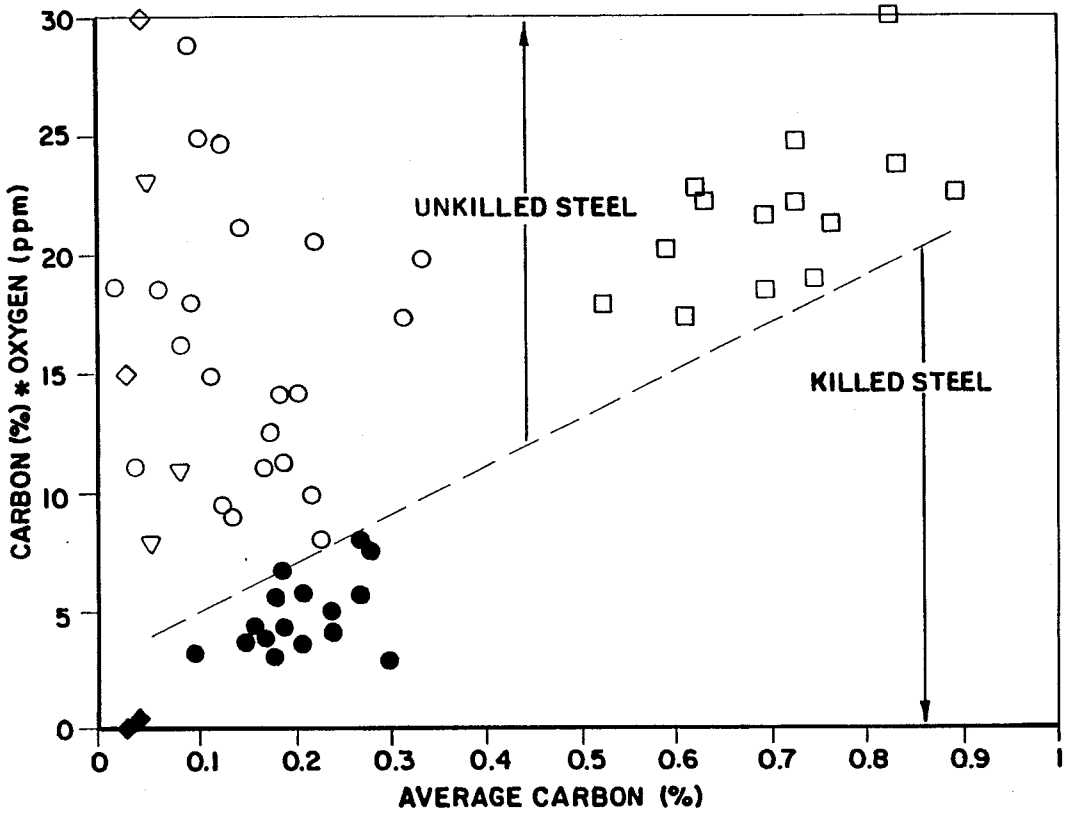
FIG. 1 is a plot of the carbon•oxygen product (i.e., the product of the percent carbon times the ppm of oxygen) versus percent carbon for various killed and unkilled steel melts.

As stated earlier, the present invention is a process for the removal of hydrogen from molten ferrous alloys (steel) in the unkilled state via a chemical reaction with a halogen-containing compound. The halogen-containing compound is typically introduced into the molten alloy in the gaseous state. The process can be carried out in a conventional ladle metallurgy station.

In a preferred embodiment of the process, molten steel from a melting or refining vessel (e.g., EAF, AOD, etc.) is tapped into a ladle, however the process treatment can be performed in any molten metal treatment vessel equipped with a fume collection system. The steel must be in a non-deoxidized or "unkilled" state, that is being virtually absent of strong deoxidizers such as: Si, Al, Ti, Zr, etc. Then, a halogen-containing compound is injected into the steel and hydrogen is then removed by a chemical reaction with the halogen in the halogen-containing compound. The reaction is of the form:

$$XF_r + rH \rightleftharpoons rHF + X$$

where "F" designates a halogen After the hydrogen removal is completed, appropriate alloying and deoxidizing additions are made. The steel can then be cast using the convetional shop practice.

The preferred halogen-containing compounds are gases, in particular, sulfur hexafluoride ($SF_6$), tetrafluormethane ($CF_4$), and dichlorodifluormethane ($CCl_2F_2$) which is sold under the trademark of Freon 12. These halogen-containing gases can be blended with inert gases such as helium and argon, however, such blends do not show any process advantage over use of the pure gases. In theory, the halogen-containing compound can be any halogen-containing compound which exhibits a negative reaction free energy whether or not such compound is a gas. Gases are preferable because of the ease of introduction into the molten alloy. Table I lists many halogen-containing compounds. As stated, compounds which exhibit a positive reaction free energy are not potential candidates. Also, many of the compounds which do possess a negative reaction free energy may not be of commercial interest because of excessive cost or associated health hazards.

TABLE I

HALOGEN-CONTAINING COMPOUNDS

| Halogen Containing Compound | Chemical Reaction | Reaction Free Energy Per Mol H Removed (kcal) |
|---|---|---|
| $BF_3$ | $BF_3 + 3\underline{H} \rightleftharpoons \underline{B} + 3HF$ | +20.9 |
| $BCl_3$ | $BCl_3 + 3\underline{H} \rightleftharpoons \underline{B} + 3HCl$ | +11.3 |
| $CF_4$ | $CF_4 + 4\underline{H} \rightleftharpoons \underline{C} + 4HF$ | −33.0 |
| $CCl_4$ | $CCl_4 + 4\underline{H} \rightleftharpoons \underline{C} + 4HCl$ | −61.4 |
| $NF_3$ | $NF_3 + 3\underline{H} \rightleftharpoons \underline{N} + 3HF$ | −59.4 |
| $F_2$ | $F_2 + 2\underline{H} \rightleftharpoons 2HF$ | −54.4 |
| $Cl_2$ | $Cl_2 + 2\underline{H} \rightleftharpoons + 2HCl$ | −18.0 |
| NaF | $NaF + \underline{H} \rightleftharpoons (Na) + HF$ | +29.8 |
| NaCl | $NaCl + \underline{H} \rightleftharpoons (Na) + HCl$ | +38.1 |
| $MgF_2$ | $MgF_2 + 2\underline{H} \rightleftharpoons (Mg) + 2HF$ | +22.6 |
| $MgCl_2$ | $MgCl_2 + 2\underline{H} \rightleftharpoons (Mg) + 2HCl$ | +30.6 |
| $AlF_3$ | $AlF_3 + 3\underline{H} \rightleftharpoons \underline{Al} + 3HF$ | +16.4 |
| $AlCl_3$ | $AlCl_3 + 3\underline{H} \rightleftharpoons \underline{Al} + 3HCl$ | +16.1 |
| $SiF_4$ | $SiF_4 + 4\underline{H} \rightleftharpoons \underline{Si} + 4HF$ | +9.2 |
| $SiCl_4$ | $SiCl_4 + 4\underline{H} \rightleftharpoons \underline{Si} + 4HCl$ | +1.6 |
| $PF_5$ | $PF_5 + 5\underline{H} \rightleftharpoons \underline{P} + 5HF$ | −8.7 |
| $PCl_5$ | $PCl_5 + 5\underline{H} \rightleftharpoons \underline{P} + 5HCl$ | −17.8 |
| $SF_6$ | $SF_6 + 6\underline{H} \rightleftharpoons \underline{S} + 6HF$ | −38.4 |
| $SCl_2$ | $SCl_2 + 2\underline{H} \rightleftharpoons \underline{S} + 2HCl$ | −26.3 |
| $CaF_2$ | $CaF_2 + 2\underline{H} \rightleftharpoons (Ca) + 2HF$ | +53.0 |
| $CaCl_2$ | $CaCl_2 + 2\underline{H} \rightleftharpoons (Ca) + 2HCl$ | +50.6 |
| $TiF_3$ | $TiF_3 + 3\underline{H} \rightleftharpoons \underline{Ti} + 3HF$ | +17.7 |
| $TiC_3$ | $TiCl_3 + 3\underline{H} \rightleftharpoons \underline{Ti} + 3HCl$ | +11.3 |
| $TiF_4$ | $TiF_4 + 4\underline{H} \rightleftharpoons \underline{Ti} + 4HF$ | +13.8 |
| $TiCl_4$ | $TiCl_4 + 4\underline{H} \rightleftharpoons \underline{Ti} + 4HCl$ | +10.7 |
| $CrF_2$ | $CrF_2 + 2\underline{H} \rightleftharpoons \underline{Cr} + 2HF$ | +2.1 |
| $CrCl_2$ | $CrCl_2 + 2\underline{H} \rightleftharpoons \underline{Cr} + 2HCl$ | +6.7 |
| $CrF_3$ | $CrF_3 + 3\underline{H} \rightleftharpoons \underline{Cr} + 3HF$ | +3.2 |
| $CrCl_3$ | $CrCl_3 + 3\underline{H} \rightleftharpoons \underline{Cr} + 3HCl$ | +3.3 |
| $MnF_2$ | $MnF_2 + 2\underline{H} \rightleftharpoons Mn + 2HF$ | +4.6 |
| $MnCl_2$ | $MnCl_2 + 2\underline{H} \rightleftharpoons \underline{Mn} + 2HCl$ | +14.2 |
| $MnF_3$ | $MnF_3 + 3\underline{H} \rightleftharpoons \underline{Mn} + 3HF$ | −6.6 |
| $FeF_2$ | $FeF_2 + 2\underline{H} \rightleftharpoons Fe + 2HF$ | +1.5 |
| $FeCl_2$ | $FeCl_2 + 2\underline{H} \rightleftharpoons Fe + 2HCl$ | +12.3 |
| $FeF_3$ | $FeF_3 + 3\underline{H} \rightleftharpoons Fe + 3HF$ | −2.0 |
| $FeCl_3$ | $FeCl_3 + 3\underline{H} \rightleftharpoons Fe + 3HCl$ | +3.2 |
| $CoF_2$ | $CoF_2 + 2\underline{H} \rightleftharpoons Co + 2HF$ | −12.6 |
| $CoCl_2$ | $CoCl_2 + 2\underline{H} \rightleftharpoons Co + 2HCl$ | +6.5 |
| $CoF_3$ | $CoF_3 + 3\underline{H} \rightleftharpoons Co + 3HF$ | −21.7 |
| $CoCl_3$ | $CoCl_3 + 3\underline{H} \rightleftharpoons Co + 3HCl$ | −11.1 |
| $CrCl_3$ | $CrCl_3 + 3\underline{H} \rightleftharpoons \underline{Cr} + 3HCl$ | +3.3 |
| $CrCl_3$ | $CrCl_3 + 3\underline{H} \rightleftharpoons \underline{Cr} + 3HCl$ | +3.3 |
| $CrCl_3$ | $CrCl_3 + 3\underline{H} \rightleftharpoons \underline{Cr} + 3HCl$ | +3.3 |
| $CrCl_3$ | $CrCl_3 + 3\underline{H} \rightleftharpoons \underline{Cr} + 3HCl$ | +3.3 |
| $CrCl_3$ | $CrCl_3 + 3\underline{H} \rightleftharpoons \underline{Cr} + 3HCl$ | +3.3 |
| $NiF_2$ | $NiF_2 + 2\underline{H} \rightleftharpoons \underline{Ni} + 2HF$ | −17.9 |
| $NiCl_2$ | $NiCl_2 + 2\underline{H} \rightleftharpoons Ni + 2HCl$ | −5.1 |
| $CdF_2$ | $CdF_2 + 2\underline{H} \rightleftharpoons Cd\uparrow + 2HF$ | −14.0 |
| $CdCl_2$ | $CdCl_2 + 2\underline{H} \rightleftharpoons Cd\uparrow + 2HCl$ | −4.4 |
| $CuF_2$ | $CuF_2 + 2\underline{H} \rightleftharpoons \underline{Cu} + 2HF$ | −21.7 |
| $CuCl_2$ | $CuCl_2 + 2\underline{H} \rightleftharpoons \underline{Cu} + 2HCl$ | −10.1 |
| $PbF_2$ | $PbF_2 + 2\underline{H} \rightleftharpoons Pb\uparrow + 2HF$ | −6.0 |
| $PbCl_2$ | $PbCl_2 + 2\underline{H} \rightleftharpoons Pb\uparrow + 2HCl$ | +11.0 |
| $ZnF_2$ | $ZnF_2 + 2\underline{H} \rightleftharpoons Zn\uparrow + 2HF$ | −8.5 |
| $ZnCl_2$ | $ZnCl_2 + 2\underline{H} \rightleftharpoons Zn\uparrow + 2HCl$ | +16.1 |
| $WF_6$ | $WF_6 + 6\underline{H} \rightleftharpoons \underline{W} + 6HF$ | −26.8 |
| $WCl_6$ | $WCl_6 + 6\underline{H} \rightleftharpoons \underline{W} + 6HCl$ | −24.2 |

TABLE I-continued

| HALOGEN-CONTAINING COMPOUNDS | | |
|---|---|---|
| Halogen Containing Compound | Chemical Reaction | Reaction Free Energy Per Mol H Removed (kcal) |
| $CCl_2F_2$ | $CCl_2F_2 + 4\underline{H} \rightleftarrows \underline{C} + 2HCl + 2HF$ | −39.0 |
| $C_2F_6$ | $C_2F_6 + 6\underline{H} \rightleftarrows 2\underline{C} + 6HF$ | −25.5 |

The most critical factor affecting the effectiveness of the dehydrogenation process of the present invention is the level of deoxidant contained in the molten steel. Table II lists the affinity that fluorine exhibits for elements typically dissolved in molten iron. The affinity is strongest for reactions with large negative free energies and these elements will preferentially react with the fluorine before those elements which exhibit less negative reaction driving forces. Table II shows that the strong deoxidizers (Al, Si, Zr, Ti, etc.) dissolved in steel will react with fluorine preferentially to the reaction involving hydrogen. A similar trend exists for chlorine affinities. It has been found during experimentation that concentrations of these elements above 0.01 wt.% greatly inhibits hydrogen removal. Simultaneous removal of hydrogen and silicon or aluminum will occur, but the reaction of hydrogen with the halogen is secondary and the rate decreases with increasing deoxidizer concentration.

TABLE II

| FLUORINE AFFINITY ASSESSMENT (Standard Reaction Energies Only, T = 1,838° K.) | |
|---|---|
| $4/3\ \underline{Al} + 4 \rightleftarrows 4/3\ AlF_3 + \underline{C}$ | ($\Delta G^\circ = -178$ kcal) |
| $\underline{Si} + CF_4 \rightleftarrows SiF_4 + \underline{C}$ | ($\Delta G^\circ = -143$ kcal) |
| $4\underline{H} + CF_4 \rightleftarrows 4HF + \underline{C}$ | ($\Delta G^\circ = -102$ kcal) |
| $\frac{2}{3}\ \underline{Fe} + CF_4 \rightleftarrows \frac{2}{3}\ FeF_2 + \underline{C}$ | ($\Delta G^\circ = -74$ kcal) |

(Note: Zr, Ti are above H ; Cr, Zn, Cu, Mn are below Fe)

The most successful dehydrogenation was accomplished when the carbon•oxygen product was above the dashed line as shown in FIG. 1. This range is referred to as "unkilled,""open," or non-deoxidized steel, which means the virtual absence of strong deoxidizers.

Finally, the dehydrogenation process of the present invention is performed at ambient pressure and does not require vacuum equipment. The hydrogen removal reactions are thermodynamically favorable at all steelmaking temperatures (1,800°-2,000° K.). This process is capable of treating all grades of steel and iron including ultra-low, low, medium, and high carbon steels.

EXAMPLES

In order to demonstrate the efficacy of the present invention and to provide side by side comparisons with the prior art, the following test runs were done.

In the test runs, an appropriate amount of iron and steel scrap was charged into an induction furnace or electric arc furnace and melted to the desired composition and temperature. For tests which used 20 lbs, 200 lbs, or 1,000 lbs, an induction furnace was used to treat the steel; for tests which used 16,000 lbs of metal, a ladle was used to treat the steel. Following adjustment of the steel chemistry and temperature, a complete analysis of the melt was made. For heats in which a deoxidant was charged, the heat was analyzed or dissolved oxygen was measured using the standard oxygen cell technique to determine whether the heat was open or killed. Samples were taken with a dual-wall sampler to determine the hydrogen content. Once the steel was completely analyzed, the appropriate amount of reactive gas was determined for removal of the dissolved hydrogen. The reactive gas was injected through a bottom-located mini-tuyere underneath the steel bath in the 20 lb and 200 lb heats, and with a top-injection lance, which is described in U.S. patent application Ser. No. 07/276255 filed 11/23/1988, at an immersion depth of approximately one-half of the bath depth for the 1,000 and 16,000 lb heats. At the completion of the injection, once again, complete analyticals were run. The steel bath was maintained above the liquidus temperature for steel during the treatments.

Table III lists a series of experiments in which the aim hydrogen level of 21 2 ppm were attained. These data show that the process was effective over a wide range of hydrogen levels. Note that the dehydrogenation process works for both killed and unkilled steel. Several examples for each gas and deoxidizer type are listed. However, a significant improvement in removal rate is realized when unkilled or open steel is treated.

TABLE III

| SUMMARY OF EXPERIMENTAL RESULTS FOR FINAL HYDROGEN LEVELS BELOW 2PPM | | | | | | | | |
|---|---|---|---|---|---|---|---|---|
| | Hydrogen Level (PPM) | | | | Total lb | | | |
| Wt (lb) | Start | End | Delta | Gas Type | SCF/ton | Fluorine/ton | Killed | Efficiency (%) |
| 20 | 4.6 | 0.5 | 4.1 | $SF_6$ | 6.0 | 1.88 | No | 8.3 |
| 200 | 6.1 | 1.9 | 4.2 | $SF_6$ | 5.9 | 1.85 | Yes (Al) | 8.6 |
| 200 | 7.1 | 1.2 | 5.9 | $SF_6$ | 9.0 | 2.80 | No | 8.0 |
| 200 | 4.3 | 1.3 | 3.0 | $CF_4$ | 20.0 | 3.92 | Yes (Al) | 2.9 |
| 200 | 2.7 | 1.0 | 1.7 | $CF_4$ | 20.4 | 4.00 | Yes (Al) | 1.6 |
| 200 | 3.8 | 1.8 | 2.0 | $CF_4$ | 19.8 | 3.88 | Yes (Al) | 2.0 |
| 200 | 6.5 | 1.6 | 4.9 | $CF_4$ | 20.0 | 3.92 | Yes (Si) | 4.7 |
| 200 | 1.9 | 0.9 | 1.0 | $CF_4$ | 19.8 | 3.88 | Yes (Si) | 1.0 |
| 200 | 4.2 | 1.0 | 3.2 | $CF_4$ | 18.3 | 3.59 | Yes (Si) | 3.3 |
| 200 | 9.7 | 1.7 | 8.0 | $CF_4$ | 20.6 | 4.04 | Yes (Si) | 7.5 |
| 200 | 3.5 | 0.9 | 2.4 | F—12*** | 28.2 | 8.09* | Yes (Si) | 1.1 |
| 200 | 3.5 | 1.7 | 1.8 | $CF_4$ | 24.0 | 4.70 | Yes (Si) | 1.4 |
| 200 | 7.0 | 1.3 | 5.7 | $SF_6$ | 16.2 | 5.10 | Yes (Si) | 4.2 |
| 200 | 5.1 | 1.1 | 4.0 | $CF_4$ | 24.0 | 4.70 | Yes (Si) | 3.2 |

TABLE III-continued

SUMMARY OF EXPERIMENTAL RESULTS FOR FINAL HYDROGEN LEVELS BELOW 2PPM

| | Hydrogen Level (PPM) | | | | | Total lb | | |
|---|---|---|---|---|---|---|---|---|
| Wt (lb) | Start | End | Delta | Gas Type | SCF/ton | Fluorine/ton | Killed | Efficiency (%) |
| 200 | 5.5 | 1.8 | 3.7 | $SF_6$ | 16.1 | 5.00 | Yes (Si) | 2.8 |
| 200 | 3.9 | 1.9 | 2.0 | $SF_6$ | 15.4 | 4.80 | Yes (Si) | 1.6 |
| 1000 | 4.0 | 1.5 | 2.5 | $CF_4$ | 16.0 | 3.20 | Yes (Si) | 3.6 |
| 1000 | 6.3 | 1.5 | 4.8 | $SF_6$ | 12.0 | 3.75 | Yes (Si) | 4.9 |
| 1000 | 5.8 | 1.9 | 3.9 | $CF_4$ | 16.0 | 3.20 | No | 4.6 |
| 1000 | 4.5 | 1.5 | 3.0 | $CF_4$ | 16.0 | 3.20 | No | 3.5 |
| 1000 | 5.5 | 1.3 | 4.2 | $CF_4$ | 10.0 | 1.96 | No | 8.1 |
| 1000 | 8.3 | 1.1 | 7.2 | $CF_4$ | 12.0 | 2.35 | No | 11.6 |
| 1000 | 6.0 | 1.7 | 4.3 | F—12 | 8.6 | 2.47* | No | 6.6 |
| 1000 | 3.9 | 0.9 | 3.0 | F—12 | 8.9 | 2.55* | No | 4.4 |
| 1000 | 3.2 | 1.1 | 2.1 | F—12 | 8.0 | 2.30* | No | 3.5 |
| 1000 | 3.0 | 1.4 | 1.6 | $CF_4$ | 10.0 | 1.96 | No** | 4.0 |
| 1000 | 3.3 | 1.6 | 1.7 | F—12 | 6.0 | 1.72* | No** | 3.8 |
| 1000 | 8.3 | 1.3 | 7.0 | F—12 | 22.0 | 6.31* | No | 4.2 |
| 1000 | 8.5 | 1.5 | 7.0 | F—12 | 11.5 | 3.30* | No | 8.1 |
| 1000 | 12.0 | 1.9 | 10.1 | F—12 | 16.5 | 4.73* | No | 8.1 |
| 1000 | 7.6 | 0.9 | 6.7 | F—12 | 16.0 | 4.59* | No | 5.6 |
| 16,000 | 4.9 | 1.4 | 3.5 | F—12 | 14.5 | 4.17* | No | 3.2 |

*Lb Cl & F
**Residual Si >0.015.
***F—12 = $CCl_2F_2$

To more specifically illustrate the method of the present invention for treating steel to remove hydrogen the following two examples are offered.

Example 1

A 16,000 lb (7,272 kg) heat of steel was treated in a ladle to reduce the hydrogen content. The temperature of the steel before treatment was 2912° F. (1600° C.) and the steel analysis was 0.73% C, 0.49% Mn, 0.022% P, 0.016% S, <0.01% Si, and <0.005% Al. An oxygen cell was used to measure the oxygen content of the steel. The measured oxygen content of 30.4 ppm of the steel at a carbon content of 0.73% C results in a C•O of 22.2. FIG. 1 indicates that a C•O of 22.2 at 0.73% C is an unkilled or open heat. The steel was sampled before treatment for hydrogen using a dual-wall immersion samples and the steel contained 4.91 ppm total hydrogen. An air-cooled injection lance was lowered into the bath approximately 18 inches (50% immersion depth) and $CCl_2F_2$ was injected into the bath at a rate of 11.0 SCFM for 10.5 minutes for a total injection of 115.5 SCF of $CCl_2F_2$. At the end of the treatment, the injection lance was raised from the steel and the steel was sampled. The hydrogen level after the treatment was 1.43 ppm. The bath temperature was 2778° F. (1525° C.) and the steel analysis was 0.70% C, 0.35% Mn, 0.023%P, 0.016% S, <0.01% Si, and <0.005% Al. The steel analysis can be adjusted to any desired composition using standard techniques of adding alloys to the ladle and the temperature adjusted using well-known heating or cooling techniques.

Example 2

A 1,000 lb (454 kg) heat of steel was treated in an induction furnace to reduce the hydrogen content. The temperature of the steel before treatment was 2880° F. (1582° C.) and the steel analysis was 0.044% C, 0.028% Mn, 0.042% P, 0.019% S, <0.01% Si, and <0.005% Al. There was no deoxidant charged to this heat so the heat was considered open or unkilled prior to treatment. The analysis of the steel after the treatment confirmed that the heat was unkilled or open. The steel was sampled before treatment for hydrogen using dual-wall immersion sampler and the steel contained 8.30 ppm total hydrogen. An air-cooled injection lance was lowered into the bath approximately 12 inches (56% immersion depth) and tetrafluoromethane ($CF_4$) was injected into the bath at a rate of 1.0 SCFM for 6.0 minutes for a total injection of 6.0 SCF of $CF_4$. At the end of the treatment, the injection lance was raised from the steel and the steel was sampled; the hydrogen level after the treatment was 1.1 ppm. The steel analysis was 0.030% C, 0.016%Mn, 0.046% P, 0.019% S, <0.01% Si, and <0.005% Al. The steel analysis can be adjusted to any desired composition using standard techniques of adding alloys to the induction furnace or ladle and the temperature adjusted.

The impact of the halogen dehydrogenation treatment on the steelmaking process can be assessed by examining the changes which occur in the steel, slag and off-gas. The steel and slag chemistries were documented using standard laboratory techniques. However, determining the off-gas composition required a combination of x-ray phosphorescent spectroscopy, infrared spectroscopy, and ion selective electrode analysis.

FIGS. 2 and 3 show the dissolved hydrogen content of the steel as a function of injected gas volume for $CF_4$ and $CCl_2F_2$, respectively.

In FIGS. 2 and 3, the slope of the line is representative of reaction rate efficiency. As slope steepness increases, so does process efficiency. The killed steel treatments are much less efficient than the open steel processing.

Figure 4:
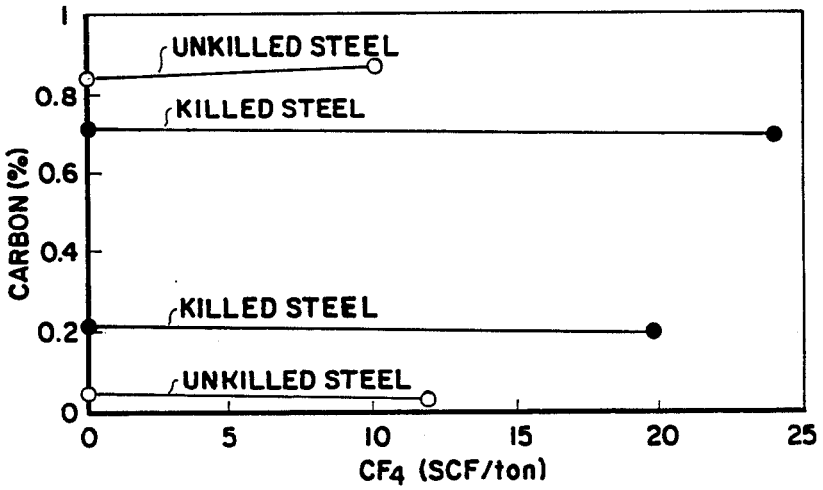
FIG. 4 is a plot showing dissolved carbon levels versus $CF_4$ injection for the removal of hydrogen from various steel melts.
Figure 5:
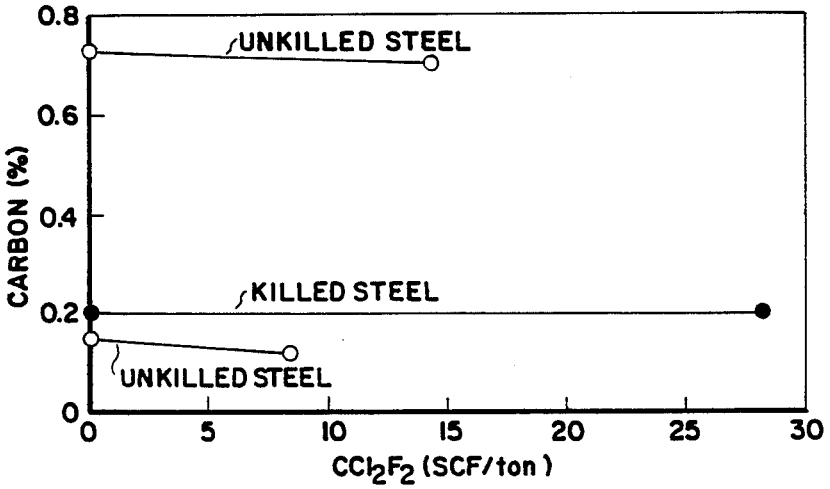
FIG. 5 is a plot showing dissolved carbon levels versus $CCl_2F_2$ injection for the removal of hydrogen from various steel melts.

FIGS. 4 and 5 show dissolved carbon contents after $CF_4$ and $CCl_2F_2$ injection, respectively. The halogen treatment has almost no effect on the carbon content of the steel. The slight decrease exhibited by the experimental data is typical of carbon losses associated with unkilled steel. The control of steel carbon content is one of the most critical operations in steelmaking and is typically accomplished using injected oxygen or carbon additions during or just after the melting/refining operations. This is typically performed prior to ladle treatment so it is important that the carbon level is not affected by the halogen dehydrogenation process.

In addition to documenting the chemical changes which occur in the molten steel, samples of the solidified ingot were examined using optical and scanning electron microscopy. The results of that investigation revealed the presence of a small number of chlorine-containing particles. A quantified level of concentration has not been determined, however, this was the only significant finding of halogen in the metal. The appearance of these particles is consistent with recent reports describing the chemical treatment of steel with $MnCl_2$ and NaCl in which carbide and other non-metallic particles containing chlorine were found in the metal. Traces of fluorine were not found in the solidified metal.

The initial slag composition for all the experimental heats was 40% $SiO_2$, 40% CaO, 110% MgO. Table IV lists the slag fluorine recoveries and other parameters measured after the halogen dehydrogenation treatments of several experimental heats. It is important to note that none of the slags examined after the $CCl_2F_2$ injections contained significant amounts of chlorine. Thus, only the slag fluorine recovery is reported for those heats.

This kinetic consideration is thought to be the limiting step in CaO conversion in slag covers over killed steels. In open steels, the major reactants formed in the metal are $FeF_2$ and HF. Table V shows that $FeF_2$ is a liquid at steelmaking temperatures. Thus, in open heats, intimate contact between the $FeF_2$ and (CaO) can occur at the slag/metal interface. The rate limiting step then becomes transport of $FeF_2$ to the slag metal interface and this is usually quite fast in a well-stirred ladle. Also note that the reaction driving force for the $FeF_2$ reaction is 25–35% larger than the gas phase reactants (HF, $SiF_4$, $AlF_3$). This also contributes to the higher conversion ratios in open heats.

Figure 6:
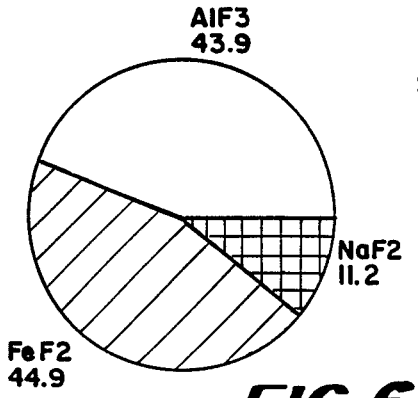
FIG. 6 is a pie chart showing average off-gas fluorine distribution from the process of the present invention using $CF_4$ for an aluminum-killed steel with no slag covering.

The off-gas analysis from the $CF_4$ treatment of an aluminum-killed steel with no slag is shown in FIG. 6. At 1,800° K., $AlF_3$ is a gas and $FeF_2$ is a high vapor pressure liquid. However, at room temperature they are both solids. Thus, the off-gas analysis involved examining the condensate captured from a water-cooled nickel tube inserted into the vent gas stream. Equal portions of $AlF_3$ and $FeF_2$ were found. This is consistent with the expectations for an aluminum-killed steel treatment.

TABLE IV

| | | | | SLAG FLUORINE RECOVERIES | | | | | | |
|---|---|---|---|---|---|---|---|---|---|---|
| # Addition CaO + $SiO_2$ | # Slag | Ending % $CaF_2$ | Ending # $CaF_2$ | Net # F Absorbed | Blend | SCF Blend | SCF Reactive Gas | # F in Gas | Killed | Fluorine Slag Recovery (%) |
| 15.0 | 16.87 | 1.5 | 0.253 | 0.033 | 50% $CF_4$ | 20.0 | 10.0 | 1.96 | Yes | 1.7 |
| 13.5 | 25.33 | 1.7 | 0.430 | 0.210 | 50% $CF_4$ | 27.2 | 18.6 | 3.65 | No | 5.8 |
| | | | | | 100% F—12 | Total | | | | |
| 14.5 | 15.57 | 3.6 | 0.560 | 0.273 | 89% $CF_4$ | 28.8 | 25.7 | 5.04 | Yes | 5.4 |
| 14.5 | 16.26 | 4.0 | 0.650 | 0.317 | 89% $CF_4$ | 25.1 | 24.1 | 4.72 | Yes | 6.7 |
| | | | | | 100% $CF_4$ | Total | | | | |
| 14.5 | 20.40 | 3.7 | 0.755 | 0.228 | 89% $CF_4$ | 13.3 | 11.6 | 2.28 | No | 10.0 |
| 14.5 | 23.60 | 5.1 | 1.200 | 0.264 | 100% $CF_4$ | 12.0 | 12.0 | 2.36 | No | 11.2 |
| 13.5 | 22.10 | 2.0 | 0.442 | 0.108 | 100% F—12 | 4.4 | 4.4 | 0.44 | No | 24.7 |
| 13.5 | 17.86 | 3.4 | 0.607 | 0.174 | 100% $CF_4$ | 3.1 | 3.1 | 0.61 | No | 28.5 |
| 13.5 | 21.08 | 3.4 | 0.716 | 0.287 | 100% $CF_4$ | 9.0 | 9.0 | 2.35 | No | 12.3 |
| | | | | | 100% F—12 | 6.0 | 6.0 | | | |
| 13.5 | 26.08 | 4.1 | 1.069 | 0.470 | 82.3% $CF_4$ | 17.8 | 14.6 | 2.87 | No | 16.3 |
| 13.5 | 20.49 | 1.8 | 0.369 | 0.130 | 82.3% $CF_4$ | 10.0 | 14.2 | 2.21 | No | 5.9 |
| | | | | | 100% F—12 | 6.0 | | | | |
| 13.5 | 17.25 | 1.8 | 0.311 | 0.118 | 100% $CF_4$ | 6.0 | 6.0 | 1.88 | No | 6.3 |
| | | | | | 100% F—12 | 7.0 | 7.0 | | | |
| 13.5 | 20.11 | 2.0 | 0.402 | 0.176 | 50% F—12 | 11.5 | 5.8 | 1.41 | No | 12.5 |
| | | | | | 100% F—12 | 8.3 | 8.3 | | | |
| 13.5 | 24.77 | 2.4 | 0.595 | 0.181 | 100% F—12 | 10.9 | 10.9 | 1.09 | No/Yes | 16.6 |

*F—12 = $CCl_2F_2$

The data in Table IV show that a maximum of 5% $CaF_2$ is formed in the slag and this represents a conversion of approximately 15% of the initial CaO content. The slag fluorine recovery was quite low for the killed heats (<7%), but reached 28.5% for the open steels.

Table V lists some of the possible slag reactions for CaO conversion to $CaF_2$. The first reactant in each equation is an assumed fluoride formed from an initial reaction of the decomposed halogen compound in the steel. It is postulated that this compound then reacts with the slag. In the case of killed steels, significant amounts of $SiF_4$ and $AlF_3$, in addition to HF, are created. Thus, the majority of the fluorine enters the slag in gaseous compounds. The residence time of these gases in the slag is quite short.

The presence of $NaF_2$ was due to sodium contamination in the process vessel. Analysis for HF in gas stream at that time was not possible, but is estimated to be 5–10% maximum because of the low dehydrogenation efficiency.

Figure 7:
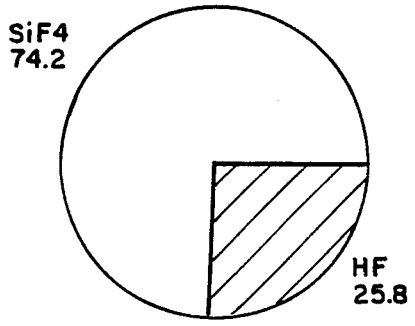
FIG. 7 is a pie chart showing average off-gas fluorine distribution from the process of the present invention using $CF_4$ for a silicon-killed steel with no slag covering.

The off-gas fluorine distribution from $CF_4$ treatment of silicon-killed steel with no slag cover is presented in FIG. 7. The pie depicts the average of off-gas analyses from experimental processing. A similar format is also followed in FIGS. 8–11. In FIG. 7, the off-gas contains significant amounts of $SiF_4$. This is consistent with the premise that silicon removal is occurring simultaneously (and preferantially) with dehydrogenation.

Figure 8:
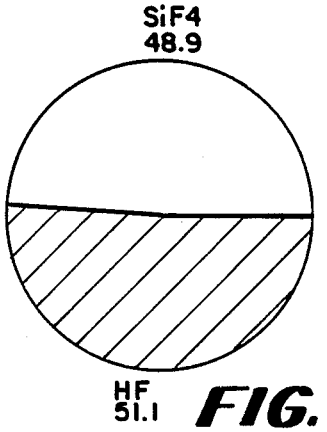
FIG. 8 is a pie chart showing average off-gas fluorine distribution from the process of the present invention using $CF_4$ for an unkilled steel with no slag covering.

FIG. 8 shows the off-gas composition for the unkilled case. Comparison with FIG. 7 shows that the HF con-

TABLE V

| POSSIBLE SLAG REACTIONS FOR CaO CONVERSION | |
|---|---|
| $FeF_{2(L)} + (CaO) \rightleftharpoons (CaF_2) + (FeO)$ | ($\Delta G^\circ = -50.5$ kcal/lb-mol $CaF_2$) |
| $2\ HF_{(G)} + (CaO) \rightleftharpoons (CaF_2) + H_2O \uparrow$ | ($\Delta G^\circ = -27.6$ kcal/lb-mol $CaF_2$) |
| $\frac{1}{2}SiF_{4(G)} + (CaO) \rightleftharpoons (CaF_2) + \frac{1}{2}(SiO_2)$ | ($\Delta G^\circ = -35.5$ kcal/lb-mol $CaF_2$) |
| $\frac{2}{3}AlF_{3(G)} + (CaO) \rightleftharpoons (CaF_2) + \frac{1}{3}(Al_2O_3)$ | ($\Delta G^\circ = -39.3$ kcal/lb-mol $CaF_2$) |

tent has doubled. This is due to the much lower dissolved silicon level in the unkilled steel. More of the halogen is allowed to react with dissolved hydrogen.

Figure 9:
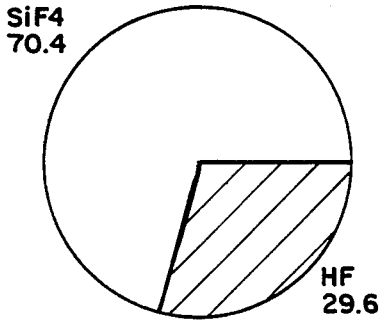
FIG. 9 is a pie chart showing averge off-gas fluorine distribution from the process of the present invention using $CCl_2F_2$ for an unkilled steel with no slag covering.

FIG. 9 contains the data from $CCl_2F_2$ injection into unkilled steel with no slag cover. The HF concentration is higher than the killed steel treatment, however, the HF concentration is much less than that shown in FIG. 8. It is assumed that chlorine reaction provide the additional hydrogen removal, in a recent experiment, twenty five percent (25%) of the injected chlorine was detected as HCl in the off-gas. As mentioned previously, the solidified steel contained a small amount of discrete chlorine-containing particles. Hydrogen removal with chlorine appears to be accomplished via several intermediate reactions and very little ever shows up in the slag. The role of chlorine in this process is not as well understood as that of the fluorine, though it does seem to reduce the amount of HF formed compared with an equivalent treatment of $CF_4$ at similar hydrogen removal efficiencies.

Figure 10:
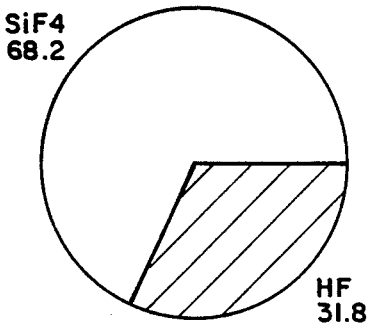
FIG. 10 is pie chart showing average off-gas fluorine distribution from the process of the present invention using $CF_4$ for an unkilled steel with a slag covering.
Figure 11:
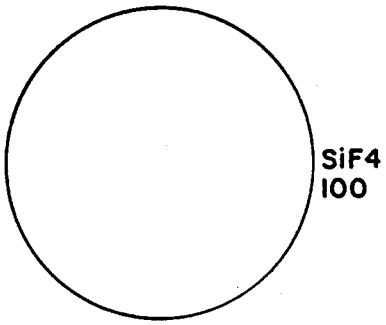
FIG. 11 is a pie chart showing average off-gas fluorine distribution from the process of the present invention using $CCl_2F_2$ for an unkilled steel with a slag covering.

FIGS. 10 and 11 contain the off-gas compositions for treatment of unkilled steel (slag covered) with $CF_4$ and $CCl_2F_2$, respectively. The experimental data in FIG. 10 does follow the trend that more HF is formed during unkilled $CF_4$ treatment, however, this is not true for the $CCl_2F_2$ injection (FIG. 11). Most of the HF could be absorbed in the slag since the initial HF concentration is much less during the $CCl_2F_2$ treatment as is shown in FIG. 9.

The above discussion illustrates a tremendous advantage of chemically removing hydrogen from unkilled steel using halogen compounds. The prior art deals with treating deoxidized (killed) steel. Table VI compares the process efficiencies and volume requirements for dehydrogenation of killed and unkilled steel.

TABLE VI

AVERAGE PROCESS EFFICIENCIES

| Gas | Killed | # Heats | Process Efficieny (%) | Average Cu Ft/Ton |
|---|---|---|---|---|
| $CF_4$ | Yes | 10 | 3.12 | 20.3 |
| $SF_6$ | Yes | 5 | 4.42 | 19.7* |
| F-12 | Yes | 1 | 1.10 | 28.2 |
| | | Average: | 3.40 | 20.6 |
| $CF_4$ | No | 5 | 6.36 | 12.8 |
| $SF_6$ | No | 2 | 8.15 | 11.3* |
| F-12 | No | 9 | 5.54 | 12.2 |
| | | Average: | 6.01 | 12.2 |

*Equivalent $CF_4$, $CCl_2F_2$ volumes

Figure 12:
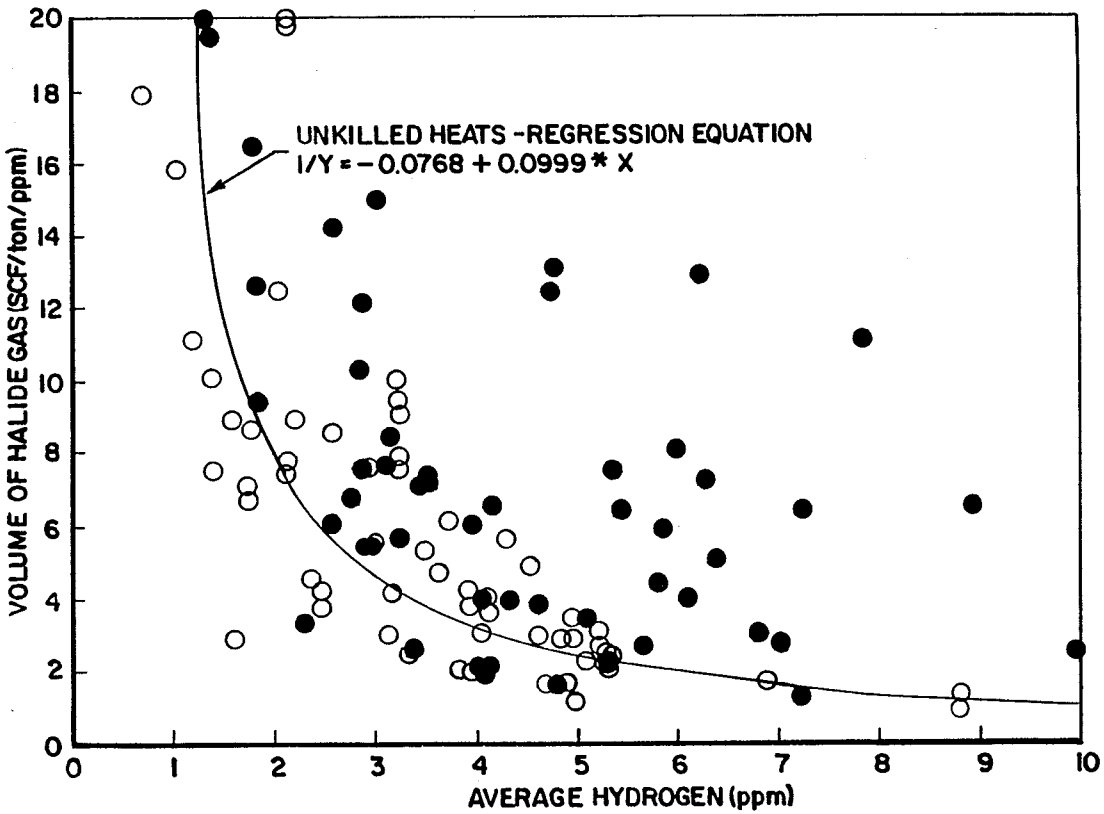
FIG. 12 is a plot of hydrogen removal efficiencies for the chemical removal of hydrogen from both killed and unkilled steels.

As can be see from Table VI, unkilled steel treatments are almost twice as efficient as their deoxidized counterparts. This allows for a reduction in the gas volume required to remove a given amount of hydrogen. This efficiency is shown graphically in FIG. 12. With reference to FIG. 12, the results for unkilled heats are illustrated by open circles and those for killed heats by filled circle. The axes shown are average hydrogen content in ppm [(initial+final)/2] and volume of halide gas required in standard cubic feet of halide gas/ton of steel/ppm of dissolved hydrogen. The solid line is a regression through the volumes required for the unkilled steel treatments. As can be observed, the reduced amount of halide gas in the standard cubic feet of halide gas per ton steel per part per million hydrogen removed (SCF/TON/PPM) required for the unkilled heats is significant. In large tonnage operations, this could translate into savings of millions of dollars per annum. This also allows for treatment times of large steel ladles in 30 minuts or less. This is very important since large temperature losses and shop scheduling problems occur when ladle treatment times are extended for more than 30 minutes.

Additionally, the equation:

$$1/Y = -0.0768 + 0.0999*X$$

where: Y=volume of halide gas and X=average hydrogen content can be used to predict the amount of gas required to reach the aim hydrogen level. This degree of process control and understanding is not reflected in any of the prior art dealing with chemical dehydrogenation.

Finally, the advantages of this invention over current vacuum and slow cooling hydrogen removal techniques are clear. The need for capital and maintenance intensive vacuum equipment is eliminated. In the slow cooling of steel products, the extended processing time, inventory tie ups and extraordinary care to ensure reliable results is greatly reduced. Hydrogen removal can be accomplished using an adaption of standard ladle treatment practices.

The present invention has been described with reference to specific embodiments thereof. These embodiments should not be viewed as a limitation on the scope of the present invention. Such scope should be ascertained by the following claims.

We claim:

1. In a process for the removal of dissolved hydrogen from molten ferrous metals by chemical reaction wherein a halogen-containing compound is admixed with the molten ferrous metal whereby the halogen in the halogen-containing compound reacts with the dissolved hydrogen to form a gaseous hydrogen halide, which is removed from the molten ferrous metal, the improvement for increasing process efficiency comprises injecting the halogen-containing compound below the surface of a bath of molten ferrous metal which is essentially free of any strong metallic deoxidizers.

2. The process of claim 1 wherein the halogen-containing compound is a halogen-containing gas which is injected into the molten ferrous metal.

3. The process of claim 2 wherein the halogen-containing gas is tetrafluoromethane.

4. The process of claim 2 wherein the halogen-containing gas is dichlorodifluoromethane.

5. The process of claim 2 wherein the halogen-containing gas is sulfur hexafluoride.

6. The process of claim 1 which further comprises adding deoxidizing and alloying metals to the molten ferrous metal subsequent to removal of dissolved hydrogen.

7. The process of claim 1 wherein the molten ferrous metal contains less than 0.01 wt% of strong metallic deoxidizers.

8. The process of claim 1 wherein the molten ferrous metal is contained in a ladle.

* * * * *